United States Patent [19]

Moriyama

[11] 4,406,443

[45] Sep. 27, 1983

[54] APPARATUS FOR DISTRIBUTING GAS-LADEN REFINING POWDERED-PARTICLES INTO MOLTEN METAL

[75] Inventor: Takashi Moriyama, Tokyo, Japan

[73] Assignee: Denka Engineering Kabushiki Kaisha, Tokyo, Japan

[21] Appl. No.: 375,146

[22] Filed: May 5, 1982

[30] Foreign Application Priority Data

Jul. 30, 1981 [JP] Japan ..... 56-120087

[51] Int. Cl.[3] ..... C21C 5/32

[52] U.S. Cl. ..... 266/225; 266/265; 75/51

[58] Field of Search ..... 266/225, 265, 266, 267, 266/268; 75/51, 52, 58, 130 A, 130 AB, 130 B, 130 BB, 130 C; 239/548, 549, 567, 251

[56] References Cited

U.S. PATENT DOCUMENTS

| | | | |
|---|---|---|---|
| 3,015,481 | 1/1962 | Clingensmith | 266/266 |
| 3,150,934 | 9/1964 | Hazard | 239/251 |
| 3,578,064 | 5/1971 | Mills et al. | 75/58 |
| 4,192,490 | 3/1980 | Nilsson et al. | 266/225 |
| 4,293,123 | 10/1981 | Sauert | 266/265 |

*Primary Examiner*—L. Dewayne Rutledge
*Assistant Examiner*—Robert McDowell
*Attorney, Agent, or Firm*—Sughrue, Mion, Zinn, Macpeak and Seas

[57] ABSTRACT

An apparatus for injecting a gas-laden refining agent into molten metal in a ladle comprises a multinozzle lance which has a plurality of introduction tubes in a lance body and a plurality of nozzles mounted in the lance body and connected to the introduction tubes, the nozzles opening substantially tangentially to an outer circumferential surface of the lance body. Each of the nozzles is molded of boron nitride and in the form of a conical taper which becomes progressively smaller in diameter toward the outer circumferential surface of the lance body. There is a system for independently distributing the gas-laden refining agent under pressure through a plurality of feed pipes which are connected to the introduction tubes, respectively, of the multinozzle lance.

7 Claims, 3 Drawing Figures

APPARATUS FOR DISTRIBUTING GAS-LADEN REFINING POWDERED-PARTICLES INTO MOLTEN METAL

BACKGROUND OF THE INVENTION

The present invention relates to an apparatus and an immersion lance for injecting a gas-laden refining agent or powdered-particles into molten metal in a ladle or converter.

It is generally preferable to provide as many lances as there are ladles or converters to facilitate up-and-down movement, installation, replacement, and servicing of the lances. Speeding up of reactions such as desulphurization requires that the lances have a plurality of nozzles for injecting a refining agent into the molten metal. Known multinozzle lances are disadvantageous in that the refining agent or powdered-particles tends to get deposited in the area where the nozzles are branched off from a single introduction tube. The deposited material eventually chokes the introduction tube and some of the nozzles, making the refining reaction insufficient and allowing the molten metal to back-flow into the choked nozzles. To eliminate the above shortcomings, it has heretofore been necessary to lower the ratio of solid material to gas in the refining agent, reduce the load of the ladle, and check and clean the nozzles each time the lance is put into operation. Therefore, the prior art multinozzle lance is inefficient for steel production.

Another problem with the conventional multinozzle lance is that only one supply nozzle and feed pipe is connected to the multinozzle lance, an arrangement which fails to control the rates of injection of the refining agent and gas flow rate for each of the nozzles in the lance.

SUMMARY OF THE INVENTION

It is an object of the present invention to provide a multinozzle lance having a plurality of nozzles and associated apparatus which is capable of independently controlling the rate of injection of a refining agent into a molten metal in a ladle.

Another object of the present invention is to provide a multinozzle lance having a plurality of nozzles which are less prone to being choked and which have a long service life.

Still another object of the present invention is to provide a multinozzle lance having nozzles shaped and oriented for injecting streams of a refining agent in a substantially tangential direction relative to an outer circumferential surface of a lance body into a molten metal to stir the latter effectively.

According to the present invention, an apparatus for injecting a refining agent into a molten metal in a ladle includes a multinozzle lance which has a plurality of introduction tubes connectable to a plurality of feed pipes of a system for distributing the refining agent under pressure, and a plurality of nozzles are connected to the introduction tubes, respectively, the introduction tubes and nozzles being mounted in a lance body. The nozzles are molded of boron nitride and in the form of a conical taper which becomes progressively smaller in diameter toward an outer circumferential surface of the lance body at which the nozzles are open. The nozzles are oriented substantially tangentially to the outer circumferential surface of the lance body so that the refining agent injected by the nozzles can effectively agitate the molten metal in the ladle.

The above and other objects, features and advantages of the present invention will become more apparent from the following description when taken in conjunction with the accompanying drawings in which certain preferred embodiments are shown by way of illustrative example.

DETAILED DESCRIPTION OF THE PREFERRED EMBODIMENTS

Figure 1:
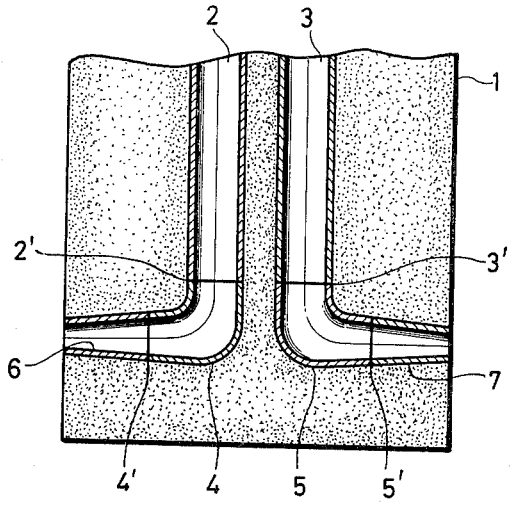
FIG. 1 is a fragmentary longitudinal cross-sectional view of a multinozzle lance according to the present invention.

As shown in FIG. 1, a multinozzle lance has a lance body 1 made of a ceramic material. A plurality of introduction tubes 2, 3 extend parallel to each other within the lance body 1 in the axial direction of the lance. The introduction tubes 2, 3 serve as reinforcements for the lance body 1. Bends or elbows 4, 5 are disposed in the lance body 1 and are connected to lower ends 2', 3', respectively, of the introduction tubes 2, 3. The bends 4, 5 have ends 4', 5' to which there are connected nozzles 6, 7, respectively, opening at an outer peripheral surface of the lance body 1. Each of the nozzles 6, 7 is preferably molded of fine ceramics, and is in the form of a conical taper which becomes progressively smaller in diameter toward the outer circumferential surface of the lance body 1.

Figure 2:
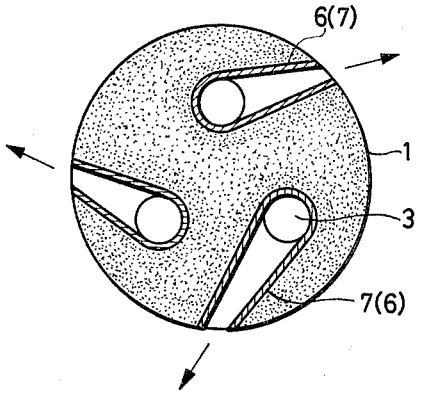
FIG. 2 is a transverse cross-sectional view of a multinozzle lance according to another embodiment.

As illustrated in FIG. 2, three introduction tubes and three nozzles may be disposed in a lance body 1, the nozzles being oriented in a direction substantially tangent to an outer circumferential surface of the lance body 1. With this arrangement, the nozzles can inject refining agents into a molten metal in a substantially tangential direction relative to the outer circumferential surface of the lance body 1, so that the molten metal can be agitated effectively.

Figure 3:
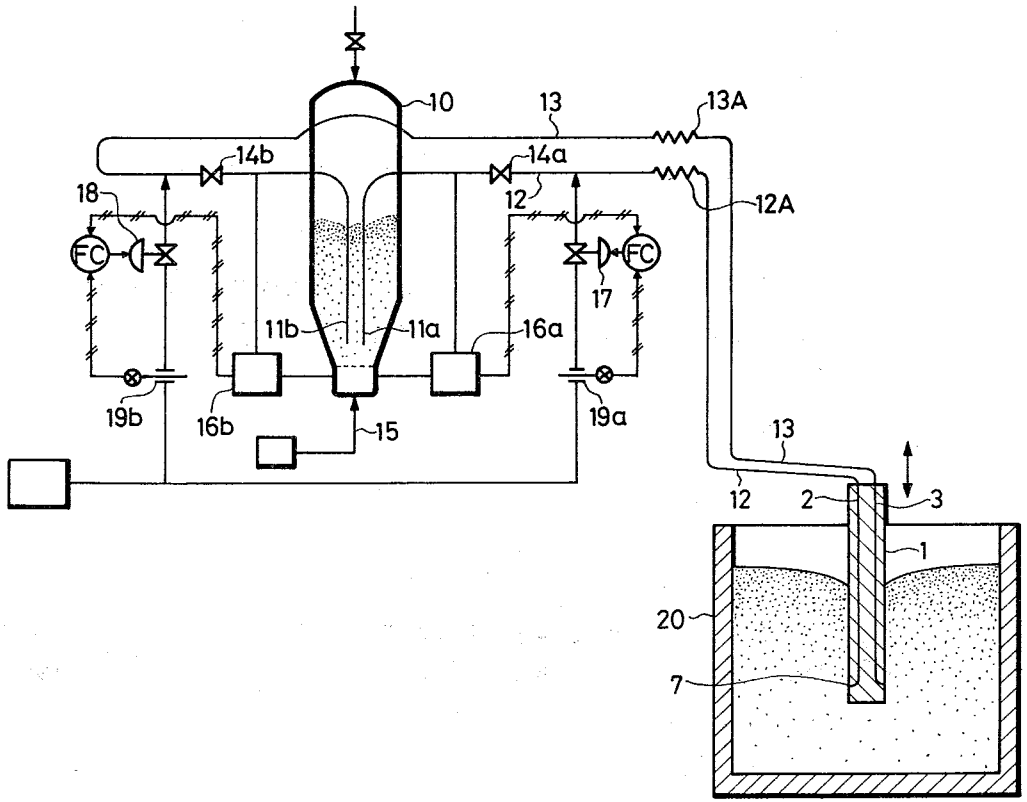
FIG. 3 is a schematic diagram of an apparatus of the present invention for distributing a refining agent under pressure to the multinozzle lance of the present invention.

FIG. 3 shows a system for distributing a gas-laden refining agent such as powdered-particles to the lance as shown in FIG. 1 which is placed in molten metal being charged in a ladle or converter 20. The system includes a pressurized vessel 10 containing the powdered-particles, which is distributed through discharge tubes **11*a*, 11*b* and transport valves 14*a*, 14*b* into transporting pipes 12, 13 under pressure, the transporting pipes 12, 13 being connected directly to the introduction tubes 2, 3 of the lance for supplying the powdered-particles into the introduction tubes 2, 3**.

The system also includes differential-pressure sensors **16*a*, 16*b* for detecting pressure differences between a pressurizing line 15 for pressurizing the vessel 10 and the transporting pipes 12, 13. Outputs from the differential-pressure sensors 16*a*, 16*b* are utilized to adjust booster flow-rate adjusting valves 17, 18, respectively, for controlling the amounts of gas-laden powdered-particles independently flowing through the transporting pipes 12, 13. Thus, the system can independently control the amounts of powdered-particles and gas which are fed separately into each of the nozzles. Designated at 19***a*, 19*b* are booster flow rate detectors. Operation of the system shown in FIG. 3 will be omitted as it can readily be understood by those skilled in the art.

With the utilization of the present invention, the total flow rate of used gas can be controlled and saved, and the power consumption for pressurizing the vessel 10 can be reduced accordingly. The multinozzle lance according to this invention agitates the molten metal in the ladle better than the conventional branched nozzle. Since the amount of gas-laden powdered-particles injected can independently be changed for a particular gas flow rate of each of the nozzles, the nozzles are prevented from being choked with the powdered-particles and hence have a relatively long service life.

Furthermore, the lance has no nozzle branch, and each nozzle is connected through a bend to a corresponding introduction tube, a construction which allows free selection of shapes and arrangements of the introduction tubes, bends, and nozzles. The axes of the nozzles may also be directed as desired.

Although certain preferred embodiments have been shown and described in detail, it should be understood that many changes and modifications may be made therein without departing from the scope of the appended claims.

What is claimed is:

1. An apparatus for distributing gas-laden refining powdered-particles under pressure into molten metal contained in a ladle, comprising:

a plurality of feed pipes;

a multinozzle lance connected to said plurality of feed pipes, said multinozzle lance including a lance body, a plurality of introduction tubes mounted in said lance body and being connected to the plurality of feed pipes, respectively, and a plurality of nozzles mounted in said lance body communicating with said plurality of introduction tubes respectively for injecting the gas-laden refining powdered-particles into said molten metal in said ladle, and means for independently controlling injection rates of the powdered-particles and the gas into each of said plurality of feed pipes to independently control said rates injected into each of said respective introduction tubes and said nozzles.

2. The apparatus according to claim 1, wherein said lance body has an outer circumferential surface, each of said nozzles being molded of boron nitride and having an end communicating with one of said introduction tubes and an opposite end opening at said outer circumferential surface, said each nozzle being progressively smaller in diameter toward said opposite end.

3. The apparatus according to claim 2, wherein said opposite end of said nozzles extends in a direction which is substantially tangent to said outer circumferential surface of said lance body.

4. The apparatus according to claim 3, wherein said multinozzle lance further comprises a plurality of elbows connected to said plurality of introduction tubes and said nozzles, respectively, for providing communication therebetween.

5. The apparatus according to claim 1, further comprising:

a pressure vessel containing said powdered-particles;

a pressurizing line for pressurizing said vessel;

said feed pipes being connected to said vessel.

6. The apparatus according to claim 5, wherein said independent injection rate controlling means includes:

a plurality of differential-pressure sensors for detecting pressure differences between said pressurizing line and each of said feed pipes;

a plurality of flow-rate adjusting valves controlled by said plurality of sensors, respectively, for independently controlling amounts of said powdered-particles in said gas flowing through each of said feed pipes.

7. The apparatus according to claim 6, wherein said independent injection rate controlling means further includes a plurality of booster flow rate detectors for each of said respective feed pipes.

* * * * *